United States Patent [19]

Lang

[11] Patent Number: 4,763,091

[45] Date of Patent: Aug. 9, 1988

[54] AIR GAP SETTING DEVICE FOR ELECTROMAGNETS

[75] Inventor: Armin Lang, Schwäbisch Gmünd, Fed. Rep. of Germany

[73] Assignee: Zahnradfabrik Friedrichshafen, AG., Friedrichshafen, Fed. Rep. of Germany

[21] Appl. No.: 44,033

[22] PCT Filed: Aug. 1, 1986

[86] PCT No.: PCT/EP86/00455

§ 371 Date: Apr. 2, 1987

§ 102(e) Date: Apr. 2, 1987

[87] PCT Pub. No.: WO87/00963

PCT Pub. Date: Feb. 12, 1987

[30] Foreign Application Priority Data

Aug. 3, 1985 [LU] Luxembourg ..... 00392

[51] Int. Cl.[4] ..... H01F 7/08

[52] U.S. Cl. ..... 335/258; 335/273

[58] Field of Search ..... 335/255, 258, 273, 274

[56] References Cited

U.S. PATENT DOCUMENTS

| | | | |
|---|---|---|---|
| 3,281,741 | 10/1966 | Beliveay | 335/258 |
| 4,034,841 | 7/1977 | Ohyama et al. | 335/258 X |
| 4,463,332 | 7/1984 | Everett | 335/258 |

*Primary Examiner*—George Harris

*Attorney, Agent, or Firm*—Zalkind & Shuster

[57] ABSTRACT

A device for setting the air gap between an armature and an energizable electromagnet, which utilizes a pin that can be force fitted in the armature by a tool forcing it against spring bias for a distance limited to the thickness of a collar on the pin. In so doing, the spring is transformed from an unstressed to a stressed condition so that upon return movement of the spring the collar, pin, and armature are actuated a distance equal to the thickness of the collar thereby setting the air gap.

5 Claims, 2 Drawing Sheets

FIG. 2
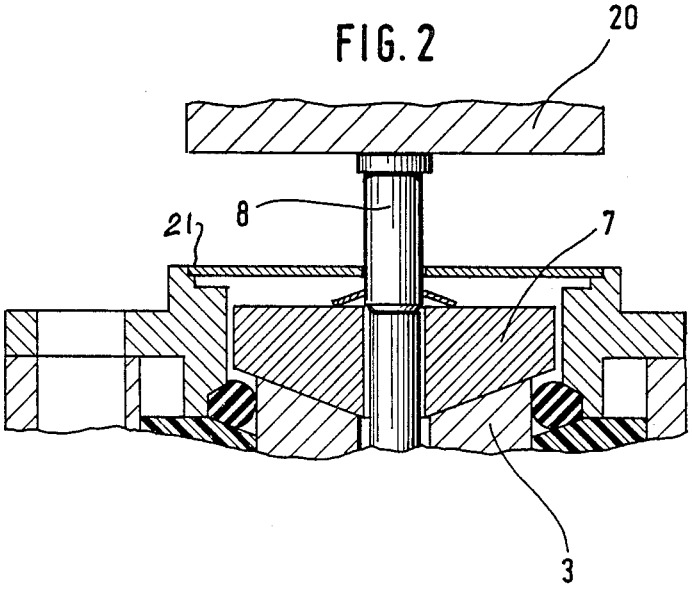
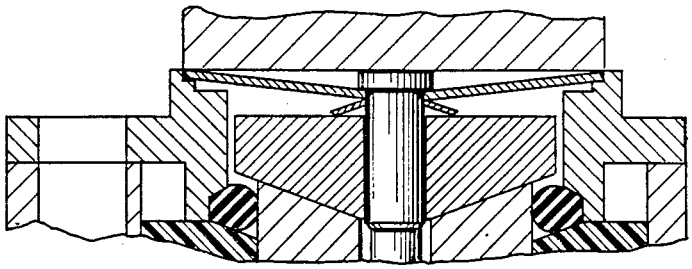
FIG. 3

AIR GAP SETTING DEVICE FOR ELECTROMAGNETS

BACKGROUND OF THE INVENTION

German utility patent 80 29 580, shows a construction for adjusting the air gap of an electrically operable valve by means of narrowing down a flux gap through a closure opening depending on the magnetic excitation of the magnetic coil. As compared to standard magnetic values, this value has the advantage that it may be proportionally energized. It operates steadily and is constructed very simply compared to usual proportional valves.

In such valves, the use of a proportional magnet is not used and the characteristic line depends largely on the basic air gap of the magnetic circuit. This basic air gap is effected by assembly of various components having tolerances. For achieving a sufficiently precise air gap, it is therefore absolutely necessary that the tolerances obtained are compensated by shims. This makes assembly more difficult and the valve more expensive. Similar problems exist in the case of gap arrangements of cam valves or couplings. In such case adjustment for a certain basic air gap must be provided.

BRIEF DESCRIPTION OF THE INVENTION

The invention provides an assembly of components that eliminates expensive and elaborate adjustment operations required of selective assembly despite the use of construction parts having customary tolerances, wherein a basic air gap is effected to obtain a precisely predictable size.

The invention utilizes an adjustable pin connected through a return spring by a press fit with an armature. The basis air gap may be varied by the length of pin force fitted into the armature. In such a construction the pin is provided with a button or collar of predetermined thickness to effect air gap size which may utilize a small spring to compensate for tolerance between the related parts.

When the thickness of the collar on the pin corresponds to the width of the basic air gap, then a suitable adjustment of the assembly is effected by a flat tool to press the pin into the armature until the upper surface of the collar and the rim of the upper surface of the return spring lie in one plane. At that time the pressing tool is released and the return spring can pull the armature up to a precise gap position.

A detailed description of the invention now follows in conjunction with the appended drawing in which:

FIG. 2 shows a first step in the adjustment of the air gap; and

FIG. 3 shows the final step.

Figure 1:
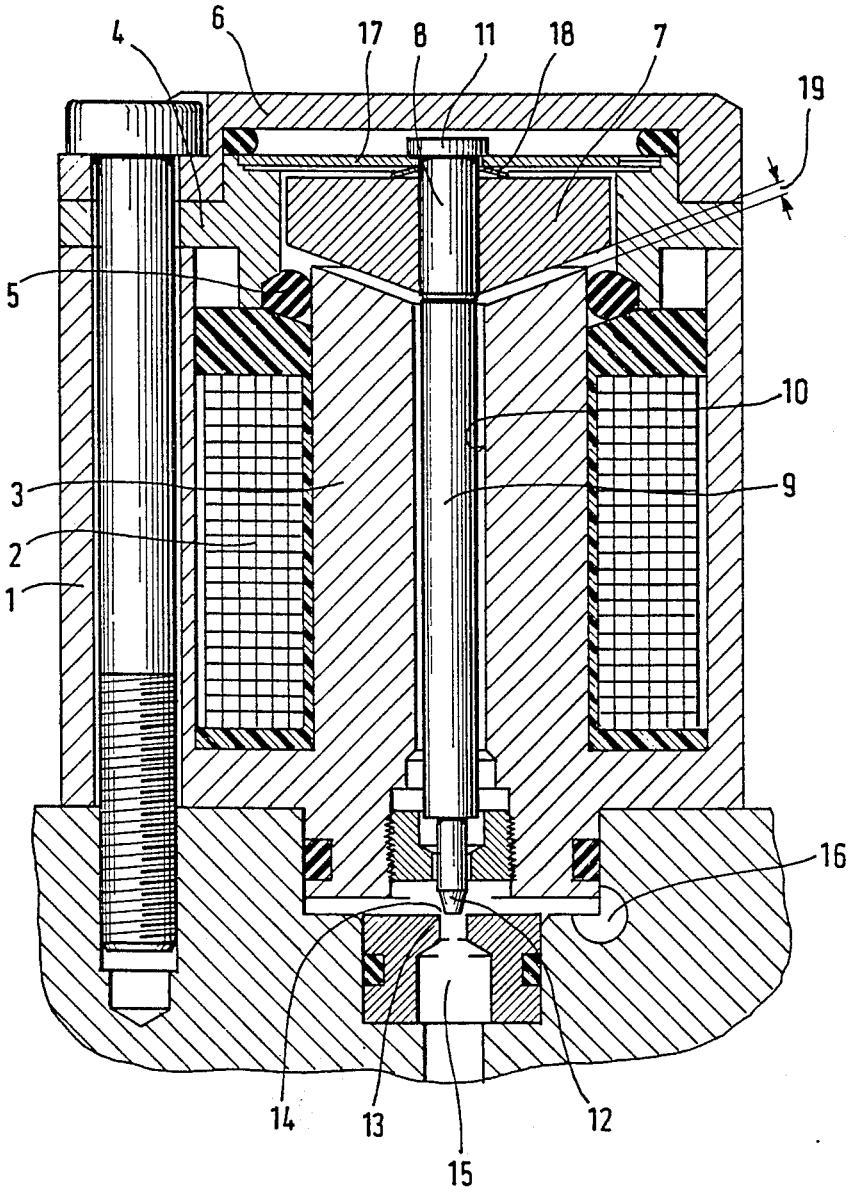
FIG. 1 shows a cross section through an electrically operated valve utilizing the invention.

In FIG. 1 an essentially potshaped housing 1 has a magnetic coil 2 which encloses a magnetic core 3. An intermediate cover 4 holds the magnetic coil 2 in the housing 1. The intermediate cover 4 holds a sealing ring 5 to seat the magnetic coil 2 within the housing. The housing 1 is closed by a sealed cover 6. A conic nonreturn armature 7 which is operable by the magnetic field of the solenoid 2 is disposed on one side of the solenoid 2 and carries a pin 8. The pin 8 consists of non-magnetizable material and has an extended valve stem 9. The valve stem 9 extends through a bore 10 in the magnetic core 3 to the other end of the solenoid 2. At one of its ends adjacent to the armature 7, the pin 8 has a button or collar 11. On the opposite end, the valve stem 9 has a conical head 12 which acts with a valve seat 13 to effect a throttling valve 14. The valve 14 is disposed between an inlet 15 and an outlet 16.

Armature 7 is the adjustable component of the arrangement, while the magnetic core 3 is the fixed component.

At one side of armature 7 in housing 1, a return disc spring 17 is disposed axially. The return spring 17 is biased centrally by a disc spring 18 disposed between armature 7 and return spring 17 which engages collar 11, as shown, to take up tolerance.

When solenoid 2 is deenergized, a predetermined basic air gap 19 exists between the magnetic core 3 and the armature 7. In this state, the armature 7 is held by the return spring 17 free of magnetic attraction.

The air gap is predetermined or may be varied in a simple manner as now described. FIG. 2 shows the step force fitting the pin 8 into the armature 7, the armature 7 being thus forced to abut magnetic core 3. In this position, the air gap 19 equals zero. The pin 8 is then forced by a flat faced tool 20 into the armature until tool 20 rests on the upper outside edge 21 of the return spring 17, which is supported on a ledge of the inside cover, as shown in FIG. 3.

When the thickness of collar 11 of pin 8 corresponds to the width of the basic air gap 19 in the deenergized state of the solenoid 2, in the final position shown in FIG. 3 of the tool 20, the upper edge of the collar 11 and the upper outside edge 21 of the return spring 17 lie in one plane. In this state therefore, the return spring 17 is bent out of place precisely by the thickness of the collar 11. When subsequently the tool 20 is lifted away, the return spring 17 springs back into its level starting position precisely by the thickness of the collar 11. In so doing return spring 17 carries pin 8 and armature 7 so that armature 7 moves upwardly by the thickness of the collar 11. The width of the basic air gap 19 in axial direction of the valve is then of the same size as the thickness of the collar 11. Thus, the tolerance of the basic air gap 19 depends only on the precision of the thickness of the collar 11. The tolerances of the remaining components have no effect.

I claim:

1. In an electromagnet comprising a magnetic core (3) energized by a solenoid (2) to attract an armature (7) separated by an air gap (19) from said magnetic core; the improvement for adjusting the air gap comprising a pin (8) force fittable in said armature and having a collar (11) of a thickness equal to the desired air gap; spring means (17) engageable with said collar and stressable when said pin is force fitted into said armature; including means (21) to limit the final portion of traverse of forced fit of said pin to the thickness of said collar wherein said spring means is stressed and whereby return movement of said spring means moves said collar along with said armature a distance equal to the thickness of said collar from said magnetic core to set the desired air gap.

2. In an electromagnet as set forth in claim 1, said spring means being a planar spring disposed intermediate said collar and said armature; said electromagnet having a housing effecting support for said planar spring and affording a recess into which said spring may be stressed when said pin is force fitted into said armature.

3. In an electromagnet as set forth in claim 2, including a spring (18) intermediate said armature and said planar spring for biasing said planar spring against the facing side of said collar.

4. In an electromagnet as set forth in claim 1, including a valve stem (9) extending from said pin and slidable in said core and having a valve head for coaction with a valve seat to form a throttling gap.

5. In an electromagnetic valve comprising a magnetic core (3) energized by a solenoid (2) to attract an armature (7) separated by an air gap (19) from said magnetic core; the improvement for adjusting the air gap comprising a pin (8) force fittable in said armature and having a collar (11) of a thickness equal to the desired air gap; spring means (17) engageable with said collar and stressable when said pin is force fitted into said armature; including means (21) to limit the final portion of traverse of forced fit of said pin to the thickness of said collar wherein said spring means is stressed and whereby return movement of said spring means moves said collar along with said armature a distance equal to the thickness of said collar from said magnetic core to set the desired air gap;

including a valve stem (9) extending from said pin and slidable in said core and having a valve head for coaction with a valve seat to form a throttling gap.

* * * * *